US006676476B1

(12) United States Patent
Lund et al.

(10) Patent No.: US 6,676,476 B1
(45) Date of Patent: Jan. 13, 2004

(54) GYROSCOPE FIGURES

(75) Inventors: Bruce D. Lund, Chicago, IL (US); Michael Starrick, Maywood, IL (US)

(73) Assignee: Lund and Company Invention, LLC, Chicago, IL (US)

( * ) Notice: Subject to any disclaimer, the term of this patent is extended or adjusted under 35 U.S.C. 154(b) by 0 days.

(21) Appl. No.: 10/335,520

(22) Filed: Jan. 3, 2003

(51) Int. Cl.[7] ..... A63H 1/20

(52) U.S. Cl. ..... 446/234; 446/275; 446/266; 446/462; 446/440

(58) Field of Search ..... 446/233, 234, 446/235, 236, 237–239, 240, 241, 246, 247, 266, 440, 462, 465, 470, 251, 275, 279, 280

(56) References Cited

U.S. PATENT DOCUMENTS 2,250,215 A * 7/1941 Berger ..... 446/237
3,932,957 A * 1/1976 Morrison et al. ..... 446/234
4,135,328 A * 1/1979 Yamasaki ..... 446/463
4,201,011 A * 5/1980 Cook ..... 446/440
4,463,515 A * 8/1984 Barlow et al. ..... 446/409
4,959,035 A * 9/1990 Murasaki ..... 446/40

* cited by examiner

*Primary Examiner*—Jacob K. Ackun
*Assistant Examiner*—Bena B. Miller

(57) ABSTRACT

A gyroscopic figure in accordance with the present invention includes a freely rotatable flywheel mounted within the figure such that the flywheel has a pre-determined orientation. A pinion gear is secured to the flywheel and a guide post is positioned a distance away from the pinion gear to form a channel therebetween. A flexible rack gear is then used to rapidly rotate the flywheel. The figure also includes a plurality of apertures. The figure may be used with a toy vehicle that includes a plurality of pegs positioned about the vehicle and sized to fit an aperture. As such when the figure is secured to the vehicle in a specific position and the flywheel is rotating, the rotating flywheel creates a gyroscopic effect that balances and stabilizes the vehicle such that the vehicle can be moved in a specific direction. In various embodiment of the present invention the vehicle may be a skateboard, a mountain board, a scooter a bicycle, or a car.

19 Claims, 5 Drawing Sheets

GYROSCOPE FIGURES

BACKGROUND OF THE INVENTION

The present invention relates to action figures that use gyroscopes to create unique actions and stunts. The use of flywheels to create various gyroscopic effects is known in the art and toy industry. For example, U.S. Pat. No. Re. 30,299 discloses a toy vehicle that includes a horizontally oriented flywheel to create various gyroscopic effects on a car. While the flywheel is rotating, the car can spin on its rear bumper, fall onto two of its wheels and travel forwards on the two wheels until it falls onto all four wheels and moves forward. The '299 patent also describes using a flywheel in two wheeled vehicles or other types of vehicles. In addition U.S. Pat. No. 3,932,957 discloses a vehicle that uses a vertically mounted flywheel and a pair of horizontally mounted discs to create a gyroscope that permits the vehicle to move in a substantially forward direction even if the vehicle is spinning.

In the above mentioned patents two distinct means of rotating the flywheels are discussed. In the '299 patent, the flywheel is frictionally rotated when the vehicle wheels are rotated and visa versa. In the '957 patent, the flywheel is rotated when a flexible rack, that engages the flywheel, is manually withdrawn from the vehicle. While the above mentioned patents disclose various gyroscopic toys and various means of initiating the rotation of the flywheel, there are always a continual need for improvements and new and novel features.

SUMMARY OF THE INVENTION

In accordance with the present invention a gyroscopic figure is provided and includes a freely rotatable flywheel mounted within the figure such that the flywheel has a pre-determined orientation. A pinion gear is secured to the flywheel and a guide post is positioned a distance away from the pinion gear to form a channel therebetween. A flexible rack gear is then used to rapidly rotate the flywheel. The figure also includes a plurality of apertures. The figure may be used with a toy vehicle that includes freely rotatable wheels and a plurality of pegs positioned about the vehicle to fit one of the apertures, such that the figure may be attached to the vehicle. As such when the figure is secured to the vehicle in a specific position and when the flywheel is rotating, the rotating flywheel creates a gyroscopic effect on the figure, such that the figure can balance on a vehicle in a predetermined position. This predetermined position is determined by the orientation of the flywheel in relation to the vehicle. A user may then move or roll the stable vehicle while the gyroscopic effect keeps the figure balanced on the vehicle. In various embodiments of the present invention the vehicle may be a skateboard, a mountain board, a scooter, a bicycle, a go-kart, or car.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
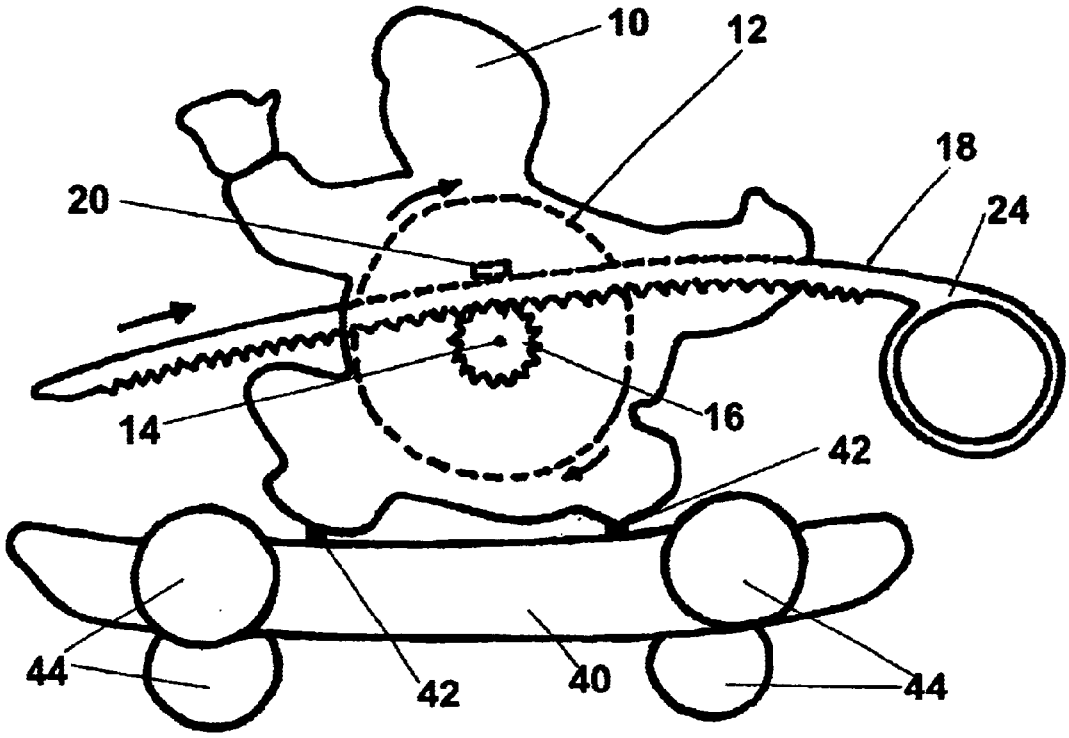
FIG. 1 is a side view illustrating a figure in accordance with the present invention showing a flywheel mounted within the figure and a flexible rack gear that is used to rotate the flywheel, the figure is also attached to a skateboard.
Figure 2:
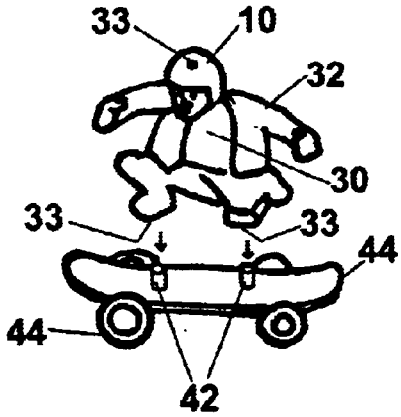
FIG. 2 is a perspective view of FIG. 1 showing the figure being attached to the skateboard using pegs.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 10:
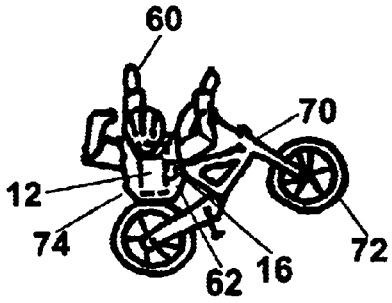
FIG. 10 is a side view of the figure attached to the bicycle and positioned on its backside and balanced on the rear wheel of the bicycle, which when the flywheel is rotating, the bicycle balances in a wheelie position and spins.

Referring now to FIG. 1, in accordance with the present invention a FIG. 10 is provided and includes a flywheel 12 rotatably mounted within the FIG. 10 on an axis, of rotation 14. The relative orientation of the flywheel 12 is substantially vertical when the FIG. 10 is in a substantially vertical position, such as defined when the FIG. 10 is standing on its feet, kneeling or standing on its head. Secured to the flywheel 12 on the axis of rotation 14 is a pinion gear 16.

Figure 4:
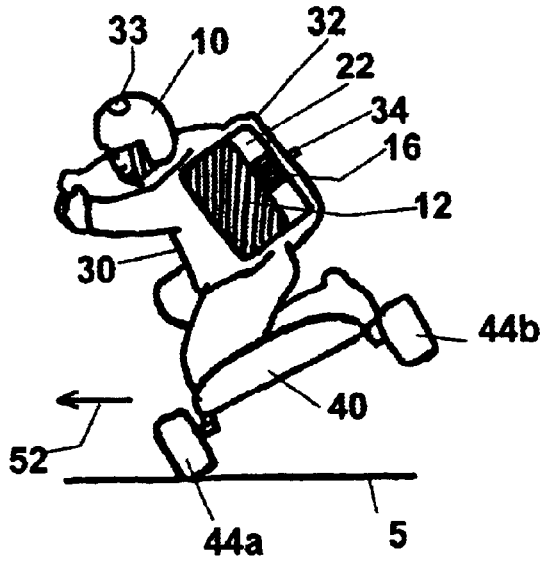
FIG. 4 is a rear view showing the figure attached to the skateboard and positioned such that the skateboard is balanced on the other two side wheels, such that when the flywheel is rotating, the skateboard balances in this position allowing a user to slide the skateboard sideways across a surface.

A flexible rack gear 18 is used with the pinion gear 16 to rapidly rotate the flywheel 12. (It is noted that other means, such as a motor mechanism, may be used to energize the flywheel.) The flexible rack gear 18 is inserted between the pinion gear 16 and a guide post 20 that is mounted within the FIG. 10 such that the teeth in the rack gear 18 and pinion gear 16 mesh together. In accordance therewith and as seen in FIG. 4, a channel 22 is formed within the FIG. 10 and about the pinion gear 16 to provide a means for the insertion of the flexible rack gear 18. Still referring to FIG. 1, the flexible rack gear 18 includes a loop 24 on one end, for a user to grab onto when manually withdrawing the flexible rack gear 18 out of the channel 22. When the flexible rack gear 18 is removed with a sufficient amount of force, the flywheel 12 will rotate with a sufficient amount of kinetic, energy to create a gyroscopic effect on the FIG. 10. As shown throughout the illustrations, this gyroscopic effect creates allows a user to balance the figure on a vehicle in various positions which further permits the user to create unique actions, stunts or movements of the vehicle in different positions or orientations.

Referring now to FIGS. 1–6, the FIG. 10 is shown attached to a skateboard 40 in different orientations. The FIG. 10 has a defined front 30 and a back 32 and includes a plurality of apertures 33 and at least one peg 34 positioned about the outside of the FIG. 10 preferably on the back 32. The apertures 33 are sized to frictionally receive vehicle pegs 42, which are located on the skateboard 40, such that the FIG. 10 does not easily fall away from the skateboard 40. The skateboard 40 also includes a plurality of freely rotatable wheels 44. It is important to note that the wheels 44 of the skateboard 40 are not directly rotated when the flywheel 12 is rotating. The rotating flywheel 12 creates a gyroscopic effect such that the skateboard 40 becomes stable and balances in various positions allowing a user to roll or move the vehicle across a surface. Moreover depending upon the orientation of the flywheel 12 in reference to the separable vehicle, the figure and vehicle will perform various movements, actions, and stunts.

Figure 3:
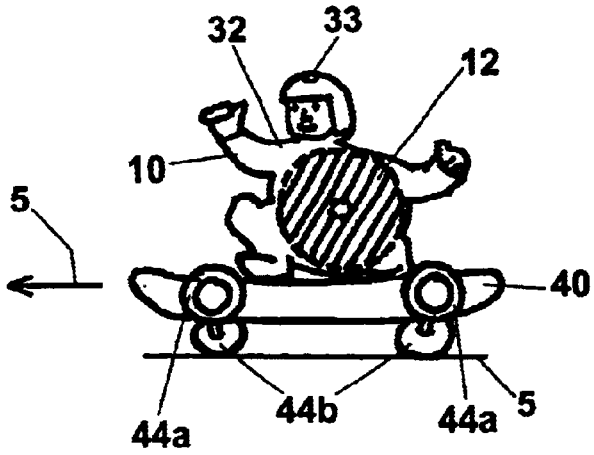
FIG. 3 is side view showing the figure attached to the skateboard and positioned such that the skateboard is on two side wheels, which when the flywheel is rotating, the figure balances the skateboard on the two side wheels allowing the skateboard to roll in this position or orientation and in a forward direction.
Figure 5:
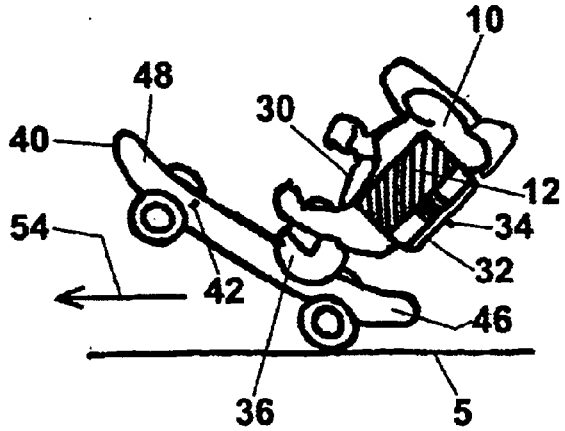
FIG. 5 is a side view showing the figure attached to the skateboard and positioned upside down on the rear of the skateboard, which when the flywheel is rotating, the skateboard balances on its rear wheels permitting a user to roll the skateboard forwards in this orientation.
Figure 6:
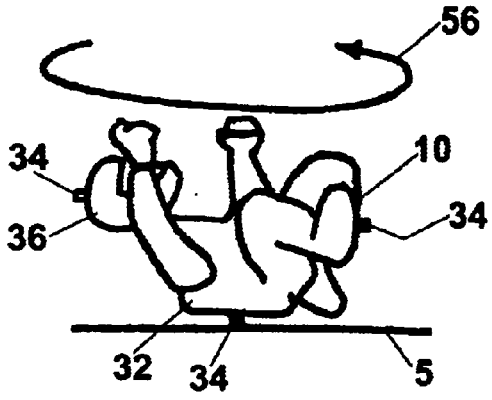
FIG. 6 is a side view of the figure shown balanced on the backside of the figure directly on a surface, which when the flywheel is rotating, the figure balances and spins on its back.

For example, in FIG. 3 the FIG. 10 is attached to the skateboard 40 in a substantially upright orientation and the skateboard 40 is tilted on its side wheels 44*b* such that the back 32 of the FIG. 10 is angled slightly towards the surface 5. When the flywheel is rotating, the skateboard 40 balances on the side wheels 44*b* allowing the skateboard to be rolled forwards, arrow 50. In FIG. 4 the skateboard 40 is tilted on its other side wheels 44*a* such that the front 30 of the FIG. 10 is angled slightly towards the surface 5. In this instance the skateboard 40 balance in this orientation permitting a user to slide the skateboard across the surface 5 in a direction indicated by arrow 52. In FIG. 5, the FIG. 10 is oriented upside down. Aperture 33 on the head 36 of the FIG. 10 is received by one of the vehicle pegs 42 about the rear portion 46 of the skateboard 40. The skateboard 40 is also tilted towards the rear, lifting the front portion 48 of the skateboard 40 off of the surface 5. The rotating flywheel 12 maintains the FIG. 10 and the skateboard 40 in this position, as the skateboard 40 is rolled, indicated by arrow 54. In FIG. 6, the FIG. 10 is placed directly on a peg 34 extending out of its back 32. The gyroscopic effect of the rotating flywheel 12 causes the FIG. 10 to spin on the surface 5, indicated by arrow 56.

The FIG. 10 may also be used with different vehicles, such as a bicycle, a mountain-board, scooter, go-kart other types of vehicles. To be used with different vehicles the FIG. 10 may have the ability to be placed in different positions by moving legs, arms, and torso, or the FIG. 10 may be a separate figure that is pre-molded to a specific position for use with a specific vehicle. To secure the figure to different vehicles, vehicle pegs are used to engage pre-positioned apertures on the figure.

Figure 7:
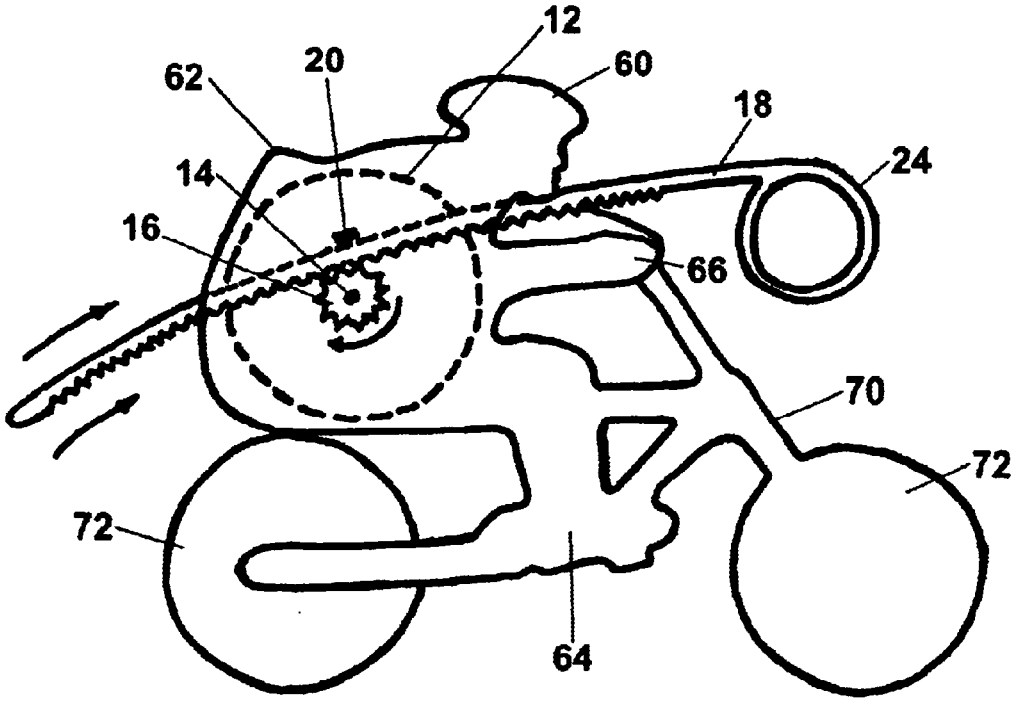
FIG. 7 is a side view of the figure shown on a bicycle.

In FIG. 7, a FIG. 60 is used with a bicycle 70. The FIG. 10 includes a flywheel 12 and a flexible gear rack 18 that is used to rotate the flywheel 12. The flywheel 12 is mounted along the back 62 of the FIG. 60 with the flywheel 12 oriented substantially in a parallel position to the freely rotatable wheels 72 of the bicycle 70. This orientation of the flywheel 12 is defined as such when the FIG. 60 is normally situated on the bicycle 70, meaning the feet 64 are placed on the pedals of the bicycle 70, the hands 66 are placed on the. handlebars of the bicycle 70 and the FIG. 60 is sitting on the bicycle seat.

Figure 8:
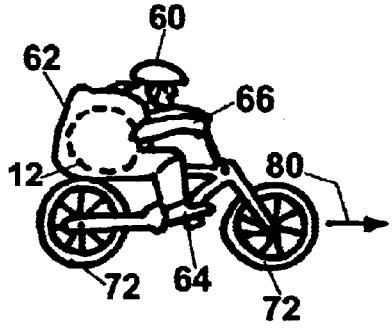
FIG. 8 is a side view of the figure attached to the bicycle and positioned normally, which when the flywheel is rotating, the bicycle balances on its wheels permitting a user to roll the bicycle forwards or backwards in this position.
Figure 11:
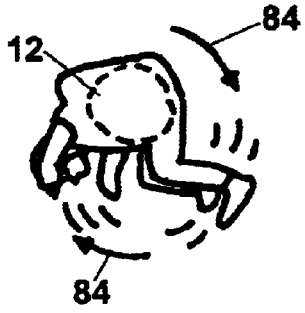
FIG. 11 is a side view of the figure attached to the bicycle and positioned directly on a surface and orientated such that the flywheel is substantially parallel to the surface, which when the flywheel is rotating, the figure spins.
Figure 9:
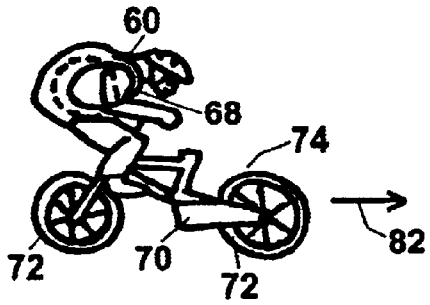
FIG. 9 is a side view of the figure attached to the bicycle and positioned backwards on the handlebars, which when the flywheel is rotating, the bicycle balances allowing a user to roll the bicycles in a backward direction.

As illustrated in FIGS. 8 through 11, the FIG. 60 may be secured to the bicycle 70 in different positions a changing the orientation of the flywheel 12 and thus changing the gyroscopic effect the rotating flywheel 12 has on the figure that allows the user to change the position on the bicycle to create various stunts and movements. In FIG. 8, the FIG. 60 is normally situated on the bicycle 70 which when the flywheel 12 is rotating, the bicycle will balance on its wheels 72 such that a user may roll the bicycle 70 forwards indicated by arrow 80. In FIG. 9, the FIG. 60 is orientated such that the front 68 of the FIG. 60 is facing towards the rear 74 of the bicycle 70. In this position the rotating flywheel 12 will cause the bicycle 70 to balance allowing a user to move the bicycle 70 backwards or in the direction the FIG. 60 is facing, indicated by arrow 82. In FIG. 10 the FIG. 60 is mounted such that the flywheel 12 is orientated 90° from its previous position. This is accomplished by mounting the FIG. 60 on its back 62 to the rear 74 of the bicycle 70. In order to secure the FIG. 60 to the rear 74 of the bicycle 70, the bicycle 70 may include a rear guard covering the rear wheel such that the wheel 72 in the rear 74 of the bicycle 70 may still rotate. In this position, the rotating flywheel 12 will allow the bicycle to maintain a "wheelie" and spin. In FIG. 11, the FIG. 60 is placed directly on a surface in an orientation that causes the orientation of the flywheel to be substantially parallel with the surface; this causes the FIG. 60 to spin as indicated by arrows 84.

Figure 12:
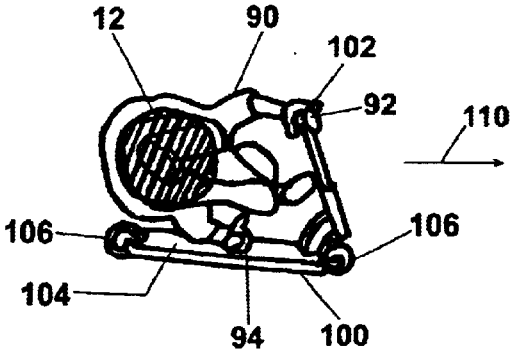
FIG. 12 is a side view of a figure attached to a scooter and positioned such that the flywheel is in a plane substantially parallel to the wheels of the scooter, which when the flywheel is rotating, the scooter balances on its wheels permitting a user to roll the scooter forwards.
Figure 13:
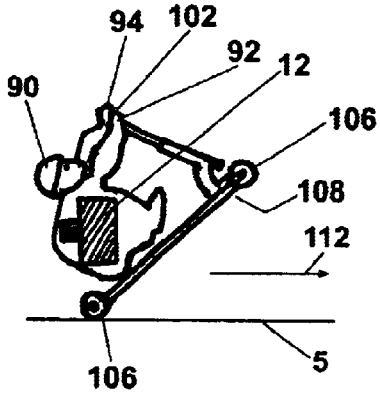
FIG. 13 is a side view of the figure attached to the scooter and positioned such that the scooter is on one wheel, which when the flywheel is rotating, the scooter balances such that a user may roll the scooter in this position.

Referring now to FIGS. 12 and 13 a FIG. 90 similarly constructed may also be used with another type of vehicle, namely a scooter 100. The FIG. 90 has the flywheel 12 mounted in an orientation that would be substantially parallel with a surface, when the FIG. 90 was in an upright position. As illustrated in FIG. 12, the FIG. 90 is positioned such that one of the hands 92 is on the handlebars 102 of the scooter 100 and another hand 94 is on the board 104 of the scooter 100. This positions the flywheel 12 in substantially a parallel plane with the rotation of the freely rotatable wheels 106 of the scooter 100. In this orientation and position a rotating flywheel will balance the scooter such that it can be rolled, indicated by arrow 110. In FIG. 13, the FIG. 90 is orientated such that the flywheel is orientated in a plane that is substantially perpendicular to a surface 5. The FIG. 90 is also positioned such that the hands 92 and 94 are attached to the handlebars 102 of the scooter 100 and the scooter 100 is angled upwardly such that the front portion 108 of the scooter 100 is not touching the surface 5. In this orientation the rotating flywheel 12 will balance the FIG. 90 and the scooter 100 such that the scooter 100 may move forwards, indicated by arrow 112.

Figure 14:
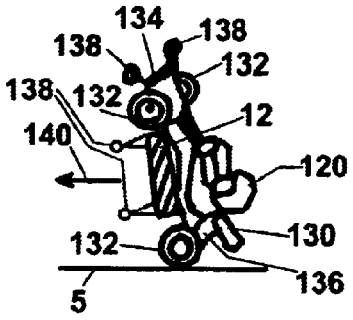
FIG. 14 is a side view of the figure attached to a car or go-kart and positioned such that the car is on its rear wheels, which when the flywheel is rotating, the car balances in a wheelie position allowing a user to roll the car forwards in this position.
Figure 15:
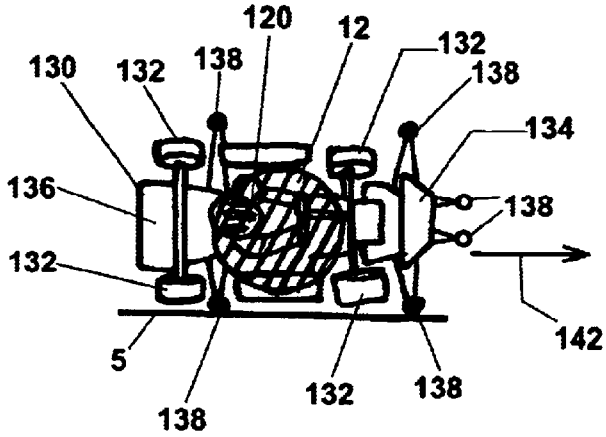
FIG. 15 is a side view of the figure attached to a car and positioned such that the car is on two side auxiliary wheels, which when the flywheel is rotating, the car may balance on these wheels allowing a user to roll the car while in this position.
Figure 16:
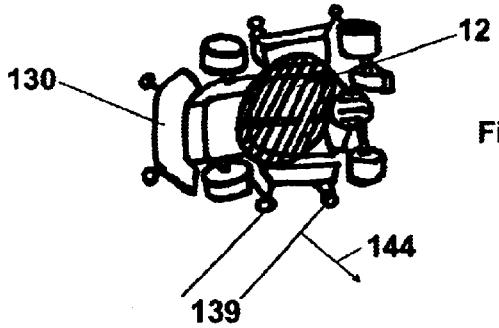
FIG. 16 is a top view of the figure attached to a car and positioned on two auxiliary wheels with axles at 90° to main axels, which when the flywheel is rotating, the car balances when rolled sideways.

In yet another embodiment (FIG. 14) a FIG. 120 is attached to a car or go-kart 130. The go-kart 130 includes freely rotatable main wheels 132 both in the front 134 and in the rear 136 of the go-kart. In addition, the go-kart 130 includes smaller freely rotatable auxiliary wheels 138 mounted from the sides of the go-kart as well as the front 134 of the go-kart 130. This allows a user to orient the go-kart 130 in various positions and when the flywheel 12 is rotating to permit the go-kart to spin or move in unique directions, such as on its side and spinning on its front end. As shown in FIG. 14, when the FIG. 120 is secured in the go-kart 130 and orientated on the main wheels 132 in the rear 136 of the go-kart, a rotating flywheel 12 will balance the go-kart 130 as it is pushed forwards, indicated by arrow 140. In FIG. 15, the go-kart is orientated on its auxiliary wheels 138, which when the flywheel 12 is rotating, the go-kart will balance on these auxiliary wheels 138 to permit a user to push the go-kart 130 in a forward direction, indicated by arrow 142. In FIG. 16, the go-kart is positioned on a pair of auxiliary wheels 139 such that the flywheel 12 is at a right angle with a surface, which when the flywheel 12 is rotating, the go-kart 130 balances on the auxiliary wheels 139 allowing a user to push the go-kart sidweways in the direction of arrow 144.

It is further noted that balance and stability is typically maintained in a specific orientation while the flywheel is rotating, allowing the vehicle to be moved in a specific direction. When the rotating flywheel slows down, balance may be lost causing the vehicle to rest on all of its wheels, if it is balanced on a portion of the wheels, or the vehicle may fall on its side. However, if the flywheel is still spinning, when balance is lost, the direction the vehicle is moving may change in accordance with any change in orientation.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A toy gyroscopic figure comprising:

a freely rotatable flywheel mounted within the figure in a pre-determined orientation;

a pinion gear secured to the flywheel;

a guide post positioned a distance away from the pinion gear to form a channel therebetween;

a flexible rack gear that when received within the channel in engagement with said pinion gear and when removed rapidly from the channel, the flexible rack gear being in engagement with said pinion gear causes the pinion gear to rotate the flywheel; and wherein when the flywheel is rotating, the rotating flywheel creates a gyroscopic effect on the figure such that when the figure is placed on a surface, the gyroscopic effect created by the positioning of the flywheel will cause the figure to become stable when moved in a specific direction move or the figure may spin.

2. The toy figure of claim 1 further comprising a plurality of apertures .

3. The toy figure of claim 2 further in combination with a separable toy vehicle that includes a plurality of pegs positioned about said vehicle and sized to fit one or more apertures, of said plurality of apertures, wherein when the figure is secured to the vehicle in a specific position and the flywheel is rotating, the position of the figure in relation to the vehicle and the orientation of the rotating flywheel creates a gyroscopic effect on the figure such that the vehicle will balance in a specific orientation to allow the vehicle to move in a predetermined direction.

4. The figure of claim 3, wherein the separable toy vehicle is a toy bicycle that includes a pair of freely rotatable wheels.

5. The figure of claim 3, wherein the separable toy vehicle is a toy skateboard having freely rotatable wheels.

6. The figure of claim 3, wherein the separable toy vehicle is a toy scooter having freely rotatable wheels.

7. The figure of claim 3, wherein the separable toy vehicle is a go-kart having freely rotatable main wheels and freely rotatable auxiliary wheels.

8. A gyroscopic figure in combination with a vehicle comprising:

a figure having a freely rotatable flywheel mounted within said figure, the flywheel having a pre-determined orientation, a pinion gear secured to the flywheel, a guide post positioned a distance away from the pinion gear to form a channel between the pinion gear and the guide post, and a plurality of apertures extending inwardly into the figure;

a flexible rack gear that when received within the channel in engagement with said pinion gear and removed rapidly from the channel, the pinion gear rotates the flywheel; and a separable toy vehicle that includes a plurality of pegs positioned about said vehicle and sized to fit one or more apertures, and includes freely rotatable wheels and wherein when the figure is secured to the vehicle in a predetermined position and the flywheel is rotating, the rotating flywheel creates a gyroscopic effect on the figure such that the vehicle will balance on said freely rotatable wheels in said predetermined position, such that a user may move the vehicle across a surface on said freely rotatable wheels while the vehicle and figure maintain the balanced predetermined position.

9. The figure of claim 8, wherein the separable toy vehicle is a toy bicycle.

10. The figure of claim 8, wherein the separable toy vehicle is a toy skateboard or mountain-board.

11. The figure of claim 8, wherein the separable toy vehicle is a toy scooter.

12. The figure of claim 8, wherein the separable toy vehicle is a go-kart also including freely rotatable auxiliary wheels and wherein when the figure is secured to the go-kart in a predetermined position and the flywheel is rotating, the rotating flywheel creates a gyroscopic effect on the figure such that the go-kart will balance on said freely rotatable wheels or freely rotatable auxiliary wheels in said predetermined position, such that a user may move the go-kart across a surface on said freely rotatable wheels or said freely rotatable auxiliary wheels while the go-kart and figure maintain the balanced predetermined position.

13. A gyroscopic figure in combination with a vehicle comprising:

a figure having a freely rotatable flywheel mounted within said figure, the flywheel having a pre-determined orientation within said figure;

a means to rotate the flywheel; and a separable toy vehicle and a means to secure the figure to said vehicle; the vehicle having freely rotatable wheels, wherein when the figure is secured to the vehicle is a specific position and the flywheel is rotating, the position of the figure in relation to the vehicle and the orientation of the rotating flywheel creates a gyroscopic effect on the figure such that the figure and the vehicle will balance in the specific position such that a user may move the vehicle on the freely rotatable wheels in a specific direction.

14. The figure in combination with the vehicle from claim 13, wherein the means to rotate the flywheel includes:

a pinion gear mounted to the flywheel, and a flexible rack gear that engages with the pinion gear such that when the flexible rack gear is removed rapidly from said engagement, the pinion gear rotates the flywheel.

15. The figure in combination with the vehicle from claim 14, wherein the means to secure the figure to said vehicle includes the vehicle having a peg extending outwardly therefrom, and the figure having an aperture positioned about said figure and sized to receive said peg.

16. The figure in combination with the vehicle from claim 15, wherein the vehicle is a toy bicycle and wherein the freely rotatable wheels include a front and rear wheel position in substantially the same plane.

17. The figure in combination with the vehicle from claim 15, wherein the vehicle is a toy skateboard or mountainboard and wherein the freely rotatable wheels include two pair of side wheels.

18. The figure in combination with the vehicle from claim 15, wherein the vehicle is a toy scooter and wherein the freely rotatable wheels include a front wheel and at least one rear wheel.

19. The figure in combination with the vehicle from claim 14, wherein the vehicle is a go-kart and wherein the freely rotatable wheels include a pair of front and a pair of rear wheels and include pairs of auxiliary wheels positioned about the go-kart.

* * * * *